United States Patent [19]

Carlson

[11] Patent Number: 4,619,950

[45] Date of Patent: Oct. 28, 1986

[54] METHOD AND MATERIAL FOR PLUGGING AN INGOT MOLD

[75] Inventor: Walter H. Carlson, Aurora, Ohio

[73] Assignee: Graphite Sales, Inc., Chagrin Falls, Ohio

[21] Appl. No.: 833,573

[22] Filed: Feb. 25, 1986

Related U.S. Application Data

[63] Continuation of Ser. No. 694,589, Jan. 24, 1985, abandoned, which is a continuation of Ser. No. 587,219, Mar. 17, 1984, abandoned.

[51] Int. Cl.[4] ..... C21B 7/12

[52] U.S. Cl. ..... 523/140; 523/141; 523/144; 523/145; 524/511

[58] Field of Search ..... 523/140, 141, 144, 145; 524/511

[56] References Cited

U.S. PATENT DOCUMENTS

| | | | |
|---|---|---|---|
| 2,913,787 | 11/1959 | Cooper | 524/145 |
| 4,022,739 | 5/1977 | Bove | 523/140 |
| 4,072,531 | 2/1978 | Funabiki et al. | 523/140 |
| 4,082,718 | 4/1978 | Ando et al. | 523/140 |
| 4,083,817 | 4/1978 | Anderson | 523/144 |
| 4,281,090 | 7/1981 | Craig | 525/501 |
| 4,430,459 | 2/1984 | Akerberg et al. | 523/144 |
| 4,452,926 | 6/1984 | Matsushima et al. | 523/145 |

FOREIGN PATENT DOCUMENTS

| | | | |
|---|---|---|---|
| 2542209 | 4/1976 | Fed. Rep. of Germany . | |
| 54-132617 | 10/1979 | Japan | 523/140 |
| 54-150412 | 11/1979 | Japan | 523/140 |
| 55-92247 | 7/1980 | Japan . | |
| 1521892 | 8/1978 | United Kingdom . | |
| 2025924 | 1/1980 | United Kingdom . | |

*Primary Examiner*—Lewis T. Jacobs

*Attorney, Agent, or Firm*—Body, Vickers & Daniels

[57] ABSTRACT

A particulate material adapted to be poured into the opening in the bottom of a top pouring ingot mold, tamped in the opening and then cured therein to form a mold plug is comprising of a plug forming aggregate and first and second binders of thermosetting resinous material having different temperatures at which polymerization of the corresponding resin commences.

16 Claims, No Drawings

METHOD AND MATERIAL FOR PLUGGING AN INGOT MOLD

This is a continuation of Ser. No. 694,589 filed Jan. 24, 1985, now abandoned, which application is itself a continuation of Ser. No. 587,219 filed Mar. 17, 1984, now abandoned.

BACKGROUND OF THE INVENTION

The present invention relates to the art of molds for forming ingots from molten metal and, more particularly, to a method and mold plug composition for plugging the opening in the bottom of a top pouring ingot mold.

Top pouring, bottom plugged ingot molds are well known in the art of metal casting. Such molds are characterized by having an opening through the bottom wall thereof which is closed by a removable plug prior to the pouring of molten metal into the top of the mold to form an ingot conforming with the mold shape which, as is also well known, can be of circular or non-circular cross-section transverse to the vertical axis of the mold. Following the casting operation, the plug is destructable to facilitate removal of the ingot from the mold by impacting a tool against the bottom of the ingot through the opening in the bottom wall of the mold.

Plugs for such ingot molds are sometimes provided as preformed ceramic or carbon elements which are introduced into the plug openings prior to the pouring of molten metal into the mold. While such preformed plugs are suitable for new molds having clean and uniform surfaces both on the bottom wall of the mold and in the plug opening through the bottom wall, they become progressively less suitable in connection with repeated use of the mold in that the bottom surface and plug opening in the mold become irregular and progressively more irregular through repeated use of the mold. Moreover, the preforming required in connection with such plugs is time consuming and expensive, and the expense thereof is promoted by the fact that the plugs are subject to breakage during removal thereof from their mold as well as during storage and introduction thereof into a mold plug opening. Such potential breakage requires care with respect to introducing the plug into the opening of an ingot mold. Furthermore, introduction of the plug into a hot ingot mold requires the use of a special tool to protect workmen from injury.

Efforts have also been made heretofore to provide a particulate material curable in situ in the plug opening of a top pouring ingot mold to plug the opening during an ingot casting operation. Such material heretofore provided includes an aggregate of suitable plug forming material and a binder which is admixed therewith and which composition is introduced into the mold plug opening so as to form a plug therein upon curing. The advantages of forming an ingot mold plug in situ as opposed to using a preformed plug include the elimination of the preforming procedure and the equipment required in connection therewith, and eliminating the requirement for care in handling to avoid loss of the plug prior to use such as through breakage. Heretofore, however, efforts to provide a plug material curable in situ have resulted in a number of problems and disadvantages which have limited acceptability thereof and, in connection with specific requirements of certain customers, has rendered the material unacceptable thereto. More particularly in this respect, for example, the materials heretofore used as a binder such as lignin sulfonate and sodium silicate have a high moisture content which has resulted in the mold plug having a moisture content of a magnitude sufficient to promote explosion of the plug and/or molten metal from the mold due to water-steam expansion. Accordingly, it will be appreciated that there has been considerable concern and reluctance to use such material from the standpoint of safety to personnel working therewith. Furthermore, such plug materials heretofore provided have been hydroscopic whereby, if there is a long period of time between plugging and the pouring of molten metal into the mold, the plug material absorbs moisture to promote or further promote the foregoing hazardous condition.

Another disadvantage in connection with curable plug materials heretofore provided resides in the inability to obtain a sufficiently strong plug to avoid contamination of the ingot metal by the plug aggregate, whereby the plug materials or the use of certain aggregates therein have been unacceptable in situations where a high degree of purity is required with respect to the ingot metal. More particularly with respect to this problem, impurities from the plug material may either enter the molten metal poured into the mold or adhere to and thus cause surface contamination of the ingot at the interface between the plug and the ingot. In the first instance, inclusions in the ingot contaminate the metal and thus down grade the ingot, and in the second instance contamination of the ingot at the end adjacent the plug requires cropping to remove the contamination and thus a loss of ingot metal. The existence of contaminating inclusions in the body of the ingot cannot be determined until the ingot is used, and the mere fact that such contamination is possible often results in a refusal to use such plug materials heretofore available.

A further disadvantage attendant to the use of curable particulate mold plug material heretofore available is the inability to sufficiently pack the material in the ingot mold hole to adequately seal the hole against the leakage of molten metal across the plug. Such leakage not only results in loss of production time but also promotes irregularity of the surface of the plug opening which reduces the useful life of the mold. Still another disadvantage resides in the fact that there has been no ability to control the curing of the plug material so as to optimize use of the plug material independent of mold temperature conditions and/or the state of cure of the material at the time molten metal is poured into the mold while, at the same time, optimizing the strength of the cured plug and minimizing the time lapse between introduction of the plug material into the mold and the time at which molten metal can then be poured into the mold.

SUMMARY OF THE INVENTION

In accordance with the present invention, a curable ingot plug composition is provided which minimizes or overcomes the foregoing and other disadvantages of both curable and preformed mold plugs heretofore provided. More particularly in this respect, a mold plug composition according to the present invention is substantially moisture free, thus minimizing the danger of explosion. Further, the composition has a broad operating temperature range providing for controlled curing of the composition in situ and use of the composition substantially independent of mold temperature at the time of introduction of the plug composition thereto. Still further, the composition enables minimizing the time lapse between introduction of the plug material into the mold opening and the pouring of molten metal into the mold, while optimizing the strength of the plug upon curing thereof. Moreover, a mold plug composition according the the present invention has good shelf life and, upon curing, can be left in the cured state for long periods of time without absorbing moisture.

The strength characteristic achieved for a mold plug in accordance with the present invention advantageously enables the use of aggregate material such as silica in situations where potential contamination of the ingot metal heretofore precluded or limited the use of such aggregate material. In this respect, the strength of the plug upon curing minimizes or eliminates potential inclusion of a plug aggregate in the ingot metal or adherence thereof to the interface between the plug and ingot. Accordingly, a plug composition according to the present invention advantageously increases selectivity with respect to plug aggregate and, furthermore, enables the use of combinations of aggregate materials which together provide desirable characteristics improving both the integrity of the plug and the condition of the ingot upon removal thereof from the mold. In this respect, for example, and as will be pointed out more fully hereinafter, combinations of plug aggregate providing a high carbon content and a refractory property advantageously enable the forming of a plug having structural integrity and good thermal characteristics and which is not wetted by the molten metal poured into the mold. Thus, potential contamination of the ingot metal by ingredients of the plug either as inclusions in the ingot or at the interface between the ingot and plug due to adhesion of the ingot metal to the plug are minimized or eliminated. As will further become apparent hereinafter, these attributes can be achieved through the use of an aggregate which is a mined product high in carbon and silica content enabling economical production of a mold plug composition having desired strength and refractory properties.

More particularly in accordance with the present invention, a mold plug composition providing the foregoing advantages is comprised of a mold plug aggregate and a non-water binding system of thermosetting resinous material to provide a plug composition having less than two percent moisture based on the total weight of the composition and, preferably, less than one percent moisture. More particularly with respect to the moisture content, a moisture content of two percent has been found to be potentially dangerous with respect to the possibility of explosion through water and steam expansion upon pouring molten metal into the mold. While such potential danger decreases as the moisture content is reduced below the two percent level, it has been found that the danger is substantially eliminated at the one percent level and below. A non-water binding system in accordance with the present invention advantageously enables the aggregate to be dried prior to mixture with the binder to achieve less than one percent moisture content for the mold plug composition.

Preferably in accordance with the present invention, a non-water binding system is provided by two water-free thermosetting resinous binders each having a different temperature at which polymerization of the corresponding resin commences. Such a combination of water-free binders enables obtaining the low moisture content desired as set forth above while further providing a broad operating temperature range which enables use of the composition substantially independent of mold temperature and provides controlled curing of the plug material to optimize the strength of the cured plug. Further through the use of a combination of resinous binders having different temperatures at which polymerization of the corresponding resin commences, a curable plug material can be provided wherein curing will commence at a relatively low temperature in accordance with the characteristics of one of the binders, and wherein curing of the material which would take place as a result of the characteristics of the one binder is retarded by the curing characteristics of the second binder. Such controlled curing enables use of the plug material substantially independent of mold temperature, and enables obtaining a cured plug having a greater strength than that which could be achieved by either of the first and second binders alone. The plug strength achieved in this manner increases selectivity with respect to the use of plug aggregates by optimizing retention of the plug aggregate against dispersion into the ingot metal or adherence to the interface between the ingot and plug. Still further by the provision of such a two binder system in accordance with the present invention, a composition can be provided wherein one of the binders acts in the manner of an anti-freeze to lower the temperature of freezing of the premixed composition, thus to improve handling and storage of the composition prior to use and minimize problems attendant to having to control the temperature in a storage area to avoid freezing or undesirable hardening of the material while in storage.

A two binder mold plug composition is prepared in accordance with the present invention by mixing appropriate portions of a suitable mold plug aggergate and first and second non-water binders of resinous material, and then packaging quantities of the composition in air tight containers, such as sealed plastic bags. In use, the mixture is tamped in place in a mold plug opening and then cured. In accordance with the preferred embodiment to be described hereinafter, characteristics of the two resinous binders provide an operating temperature range of from about ambient to about 800° F. This advantageously enables the mold plug material to be placed in the plug opening of a mold which is at ambient temperature or which is still relatively hot from a preceding casting operation, and the immediate pouring of molten metal into the plug mold, whereby curing takes place during the casting process. Alternatively, the mold plug material can be placed in the mold opening and cured in situ prior to the pouring of molten metal into the mold. In the latter instance, the curing time is dependent on the mold temperature and plug size, and curing is faster at elevated temperatures of the mold.

It is accordingly an outstanding object of the present invention to provide an improved mold plug composition of the character which is curable in situ in a plug opening in the bottom wall of a top pouring ingot mold.

Another object is the provision of a mold plug composition of the foregoing character having a minimal moisture content, thereby improving the safety of working conditions in connection with an ingot casting operation.

A further object is the provision of a mold plug composition of the foregoing character having broad operating temperature which provides improved storage and handling characteristics, use of the composition substantially independent of mold temperature, and controlled curing to optimize the strength of the cured plug.

Still another object is the provision of a mold plug composition of the foregoing character which enables minimizing contamination of the ingot metal or the interface between the ingot and mold plug.

Still a further object is the provision of a mold plug composition of the foregoing character which provides increased selectivity with respect to the ingredient or ingredients used for the plug aggregate.

Yet another object is the provision of a mold plug composition of the foregoing character comprised of a mold plug aggregate and first and second non-water binders of resinous material having different temperatures at which polymerization of the corresponding resin commences.

Still another object is to provide an improved method of plugging the bottom opening in a top pouring ingot mold.

DESCRIPTION OF PREFERRED EMBODIMENTS

In a preferred embodiment of the present invention, a mold plug composition is comprised, by weight, of from about 70% to about 90% and preferably 80%, of a suitable mold plug aggregate or mixture of aggregate materials having a screen size of about 10×0, and from about 5% to about 15%, and preferably about 10% of each of two thermosetting resinous binders having different temperatures at which polymerization of the corresponding resin commences. The first of the two non-water base thermosetting resinous binders is a phenolic binder, and the second is a Furan binder. While the binders can be obtained separately and combined when making the mold plug composition, they are available as a mixture of equal amounts of each from The Ashland Chemical Company of Columbus, Ohio under the latter's product designation 65-046.

The phenolic binder has a polymerization temperature of about 120° F. and the Furan binder has a polymerization temperature of about 300° F. The foregoing mixture of the two binders has a freezing temperature below −30° F. Both binders have a curing temperature of about 350° F. to 400° F. Characteristics of the two binders in combination provide for controlling curing of the mold plug material so as to optimize the strength of the cured plug and thus retention of the aggregate against dispersion into the ingot metal or adherence to the ingot at the interface between the ingot and mold plug. More particularly in this respect, the relatively low polymerization temperature of the phenolic binder would alone promote a quick cure of the mold plug composition to green strength and, upon full cure, would not provide a desired strength for the cured plug to provide the desired retention of the aggregate. At the same time, the relatively low polymerization temperature is advantageous from the standpoint of providing for curing to begin at a low temperature. The relatively high polymerization temperature of the Furan binder would require, if the binder were used alone, a relatively high temperature of the ingot mold for curing to begin and, like the phenolic binder alone, would not upon full cure provide the desired strength characteristic for the mold plug with respect to aggregate retention. In combination with the phenolic binder, the Furan binder retards the quick cure characteristic of the phenolic binder, whereby the binding system defined by the two binders, provides a broad operating temperature range through which curing takes place and controls the curing process so that the cured plug is stronger than that which could be achieved with either of the binders alone. Accordingly, a retention strength is achieved with respect to the aggregate which minimizes the likelihood of loss of aggregate from the plug to the ingot. Further, these two binders in combination provide an operating temperature range for curing of from ambient to about 700° F. to 800° F., and enable immediate use of the mold plug composition in connection with a casting operation by placing the composition in the mold plug opening, tamping the composition in the opening, and then pouring molten metal into the ingot mold. Most often, the ingot mold is still hot from the previous casting operation and generally is at a temperature of 350° F. or greater. A mold plug comprising eight pounds of a composition comprising 80% aggregate and 10% of each of the two binders, and thus 20% of the mixture identified above, will cure in situ in a mold at a temperature of about 350° F. in twenty-five to thirty-five minutes.

Another advantage of the above two binders in combination resides in the fact that the Furan binder functions in the manner of an anti-freeze with respect to the phonelic binder to lower the freezing temperature of the composition and thus provide for improved handling and storage capabilities. The composition is preferably packaged in quantities appropriate for providing a plug for the plug opening in a given size ingot mold, whereby an ingot mold is prepared to receive molten metal by pouring the contents of a package into the mold opening and tamping the composition in place. The plug composition can then be allowed to cure prior to the pouring of molten metal into the ingot mold, or molten metal can immediately be poured into the mold whereby curing occurs as the composition is elevated to the temperature of the molten metal. A further advantage in connection with the foreging non-water binding system is the fact that a mold plug can remain cured for long periods of time in an ingot mold prior to the forming of molten metal thereinto and the plug will not absorb moisture.

The strength and resultant aggregate retention characteristic achieved with the two binder system described above advantageously enables the use of an aggregate or combinations of aggregate which provide desirable characteristics for the plug and which, but for the strength of the plug achieved in accordance with the present invention, would preclude or limit the use of such aggregate. For example, the use of an aggregate material providing a refractory characteristic for the cured plug is advantageous from the standpoint that it retards heat transfer and reduces oxidation. The inclusion of carbon in the aggregate promotes good thermal properties and strength for the plug. It will be appreciated, therefore, that a mold plug composition according to the present invention can be prepared using a single aggregate such as sand, aluminum oxide, graphite or other carbonaceous materials such as coal mine tailings, as a customer may chose, or combinations of such materials to provide a desired carbon content and refractory characteristic to achieve the advantages referred to for the latter combination.

A preferred aggregate from the standpoint of availability and economy for providing the foregoing characteristic is comprised of a relatively inexpensive mined material known as Black Diamond to which fixed carbon, such as graphite powder, is added. Black Diamond is available from a mine by the same name in Townsend, Mont. and has a high carbon and silica content. This aggregate, when mixed with the two preferred binders, provides a composition which, upon curing, produces a mold plug having optimum hardness, thermal and refractory characteristics. More particularly in this respect, the approximate composition of Black Diamond as mined and dried for use as an aggregate in a mold plug composition according to the present invention is by weight, about 26% to about 29% fixed carbon, about 8% voltiles, and about 62% to about 65% ash. The approximate mineral analysis of the ash, based on a given quantity of Black Diamond is about 47.5% to about 50% silica, about 8.0% to about 8.4% alumina, about 2.8% to about 3.0% iron oxide, about 1.5% to about 1.6% potassium oxide, and trace amounts of magnesia, lime, titanium oxide, sodium oxide, sulphur trioxide, potassium pentoxide, and unknowns. The material as mined has a moisture content of about 3.0% and is dried to have a moisture content of less than 1% for use in the composition according to the present invention.

In connection with the preferred composition comprising 80% aggregate and 10% each of the two resinous binders, wherein Black Diamond is used in the aggregate, additional fixed carbon in the form of graphite powder, for example, is preferably mixed with a quantity of the Black Diamond to provide for the composition including the binders as prepared and prior to use to have a carbon content of from about 35% to about 39%, a silica content of from about 32% to about 34%, and an alumina content of about 5% to about 7%. In connection with the use of Black Diamond, these proportions provide a cured plug having optimum strength, refractory and thermal characteristics in combination with the two binders in the preferred embodiment. While it will be appreciated that other aggregate materials can be used alone or in various Combinations, and that the foregoing preferred amounts of carbon, silica and alumina can be provided by a mixture of such ingredients rather than through the use of Black Diamond, the mined Black Diamond provides a natural source for these materials and provides for a more economical production of the composition both from the standpoint of cost and preparation time.

While two specific binders have been identified herein as being preferred in connection with the present invention, it will be appreciated that there may be other thermosetting resinous binders operable to provide a non-water binding system and having different temperatures at which polymerization of the corresponding resin commences so as to provide controlled curing over a wide operating temperature range and a cured plug having a strength greater than that obtainable with either of the binders alone.

Having thus described the invention, it is claimed:

1. A particulate composition curable in situ in an ingot mold plug opening comprising, based on total weight of the composition, from 70% to 90% of a plug aggregate and from about 10% to 30% of a water free thermosetting resinous binder consisting of a furan resin and a phenolic resin in substantially equal amounts and having substantially different temperature at which polymerization of the corresponding resin commences, the moisture content of the composition being less than about 2%.

2. The composition according to claim 1, wherein said moisture content is less than 1%.

3. The composition according to claim 1, wherein said phenolic resin commences to polymerize at a temperature of about 120° F. and said furan resin commences to polymerize at a temperature of about 300° F.

4. The composition according to claim 1, wherein said aggregate is in an amount of about 80% by weight of said composition and said binder is in an amount of about 20% by weight of the composition.

5. The composition according to claim 4, wherein said furan resin and said phenolic resin are each in an amount of about 10%.

6. The composition according to claim 3, wherein said aggregate and said binder together have a moisture content of no more than 1% by weight of the composition.

7. The composition according to claim 6, wherein said aggregate is in an amount of about 80% by weight of said composition and each said furan resin and said phenolic resin are in an amount of about 10% by weight of said composition.

8. The composition according to claim 1, wherein said aggregate includes a minor amount of alumina.

9. The composition according to claim 8, wherein said carbon and silica together provide more than 60% by weight of said composition, and the amount of said carbon is greater than the amount of said silica.

10. The composition according to claim 1, which prior to curing comprises by weight about 35% to 39% carbon, about 32% to 34% silica, and about 5% to 7% alumina.

11. A method of plugging an opening in an ingot mold to receive molten metal comprising, mixing from about 70% to 90% of a particulate plug aggregate with from about 10% to 30% of a water free thermosetting resinous binder consisting of a furan resin and a phenolic resin having substantially differing polymerization temperatures and with said aggregate and said binder having a water content of less than about 2%, introducing a quantity of said mixture of aggregate and resinous binder into said mold opening, tamping said quantity in said opening, and curing said tamped quantity.

12. The composition according to claim 1 wherein said aggregate comprises carbon and silica as predominant ingredients.

13. The method according to claim 11 wherein said aggregate is in the amount of about 80% by weight and said resinous mixture is about 20% by weight with the furan resins and phenolic resin being present in substantially equal amounts.

14. The method according to claim 11 wherein said tamped quantity is at least partially cured by the latent heat of the ingot mold and fully cured by the heat of the molten metal.

15. A particulate hydrophobic composition curable in situ in an ingot plug opening comprising, based on total weight of the composition, from about 70% to 90% of a carbon and silica based aggregate, less than about 1% moisture and from about 10% to 30% of a non-hygroscopic phenolic-based thermosetting resinous binder comprising at least about 50% of a phenolic resin which is unmodified and an additive material for changing the curing temperature of said phenolic resin in said composition and also effective to lower the freezing point of said composition.

16. A particulate composition curable in-situ in an ingot mold plug opening comprising, based on total weight of the composition, about 70% to 90% of a plug aggregate, and about 10% to 30% of a water-free thermosetting resinous binder comprising at least 50% of a phenolic resin and an effective amount of furan resin for substantially lowering the freezing point of the phenolic resin, the moisture content of the composition being less than about 2%.

* * * * *